United States Patent [19]

Berfield

[11] Patent Number: 4,655,694

[45] Date of Patent: Apr. 7, 1987

[54] HOUSING ASSEMBLY FOR MOTOR/FAN MEANS OF A WET/DRY VACUUM CLEANER

[75] Inventor: Robert C. Berfield, Jersey Shore, Pa.

[73] Assignee: Shop-Vac Corporation, Williamsport, Pa.

[21] Appl. No.: 761,154

[22] Filed: Aug. 1, 1985

[51] Int. Cl.[4] ..... F04B 17/00; F04B 35/04

[52] U.S. Cl. ..... 417/423 A; 15/327 F; 15/413; 181/274

[58] Field of Search ..... 417/312, 368, 423 A; 415/119; 15/412, 413, 326, 327 R, 327 F; 55/276, 470, DIG. 3; 181/274, 225, 229, 277

[56] References Cited

U.S. PATENT DOCUMENTS 3,780,397 12/1973 Harbeck et al. ..... 15/413
4,435,877 3/1984 Berfield ..... 417/312

FOREIGN PATENT DOCUMENTS 41463 3/1977 Japan ..... 15/326
376815 7/1932 United Kingdom ..... 181/274
505798 3/1976 U.S.S.R. ..... 415/119

OTHER PUBLICATIONS

*Engineering,* "Silencer for Pneumatic Tools", p. 258, Sep. 7, 1934.

*Primary Examiner*—Carlton R. Croyle

*Assistant Examiner*—Donald E. Stout

*Attorney, Agent, or Firm*—Ostrolenk, Faber, Gerb & Soffen

[57] ABSTRACT

A bypass type vacuum includes a casing constructed of a cover and a motor housing disposed within the cover. A first circular partition of the motor housing defines a main expansion chamber which receives working air that is driven radially through side openings in a fan housing that surrounds a fan impeller and is disposed within the main chamber in a decidedly off-center position. A second circular partition of the cover surrounds the first partition and cooperates therewith to define a ring-like auxiliary chamber having an entrance opening in the first partition and an outlet in the second partition. Diametrically opposed constrictions provided by hand grip formations divide the auxiliary chamber into first and second sections of generally equal length, with the entrance being at the center of the first section and the outlet being at the center of the second section, the entrance also being at the portion of the first partition that is closest to the fan housing. Working air generated by the impeller flows from side openings of the fan housing into the main chamber and exits therefrom through the entrance into the first section where the working air splits and flows in opposite directions through the constrictions into the second section through opposite ends thereof, finally exiting through the outlet.

18 Claims, 7 Drawing Figures

31
20
73
89
88
83
96
91
92
49
95
48
93
71
97
16
90
15
36
22
26
32
34
61
27
24
48
42
51
44
21
25
23
43
72
19
18
17
12

HOUSING ASSEMBLY FOR MOTOR/FAN MEANS OF A WET/DRY VACUUM CLEANER

BACKGROUND OF THE INVENTION

This invention relates to so-called bypass type electric motor operated vacuum cleaners, and more particularly relates to the construction of a housing assembly for the motor/fan unit that is mounted to the lid of the vacuum cleaner tank.

Many so-called bypass type vacuum cleaners include a tank having a lid forming a removable closure for the top opening of the tank wherein sweepings are collected. This lid also mounts a fan unit, an electric motor for rotating the impeller of the fan unit and a molded insulating casing or housing assembly for the motor and fan unit. Constructions of this type are described in U.S. Pat. No. 4,330,899 issued May 25, 1982 to J. Miller et al for "Noise Reducing Blower Motor Housing Means For Vacuum Cleaner, Or The Like"; U.S. Pat. No. 4,435,877 issued Mar. 13, 1984 to R. C. Berfield for "Noise Reducing Means for Vacuum Cleaner"; and pending U.S. patent application Ser. No. 514,491 filed July 18, 1983 by J. Miller et al for an "Assembly of Tank Lid and Fan Means of a Wet/Dry Vacuum.

In those constructions, the motor housing assembly is provided with internal partitions that separate motor cooling air from the flow of working air generated by the vacuum producing main fan. In addition, housing partitions are provided to define plenums wherein the velocity of working air flow is reduced and noise is dissipated before the working air is discharged from the motor housing.

BRIEF DESCRIPTION OF THE INVENTION

In accordance with the teachings of the instant invention, the housing assembly includes a single piece molded plastic cover and a single piece molded plastic motor housing disposed within the cover. The motor/-fan unit is mounted off-center within the housing assembly in a position such that the circular fan housing is disposed eccentrically within a main expansion chamber defined by a circular partition of the motor housing. The main chamber is surrounded by an annular auxiliary chamber that is defined by the circular partition of the motor housing and a concentric circular partition of the cover. The latter is provided with recesses constituting hand grips for lifting the housing assembly and elements connected thereto. These recesses are defined by diametrically opposed formations that project into the auxiliary chamber to form constrictions that divide the auxiliary chamber into first and second sections of generally equal length.

Working air generated by the fan flows outwardly through a series of slit-like openings in the circular sidewall of the fan housing and directly into the main expansion chamber. From the latter, working air flows into the first section of the auxiliary chamber through an aperture in the circular partition of the motor housing, which aperture is disposed at the narrowest portion of the main chamber and midway between the ends of the first section. At this point, the working air divides and flows to opposite ends of the first section and through the constrictions formed by the hand grip formations into the second section of the auxiliary chamber. Working air in the second section flows toward an outlet that is centrally located in the circular partition of the cover. A fitting surrounding the housing is provided to connect a hose for converting the vacuum to blower.

Accordingly, the primary object of the instant invention is to provide an economical construction for a vacuum cleaner wherein the vacuum cleaner housing elements are utilized as means to reduce noise.

Another object is to provide a vacuum cleaner of this type wherein all working air is discharged through a single outlet port so that a hose may be attached thereto whereby the discharged working air may be utilized for blowing purposes.

Still another object is to provide a vacuum cleaner of this type wherein the vacuum cleaner housing elements have formations that constitute strong comfortable recesses to act as lifting means.

A further object is to provide a vacuum cleaner of this type constructed to facilitate assembly thereof.

A still further object is to provide a vacuum cleaner of this type in which overall costs of production are reduced.

These objects as well as other objects of this invention shall become readily apparent after reading the following description of the accompanying drawings in which:

BRIEF DESCRIPTION OF THE DRAWINGS

FIG. 3 is a vertical cross-section through line 3—3 of FIG. 2 looking in the direction of arrows 3—3.

DETAILED DESCRIPTION OF THE DRAWINGS

Figure 1:
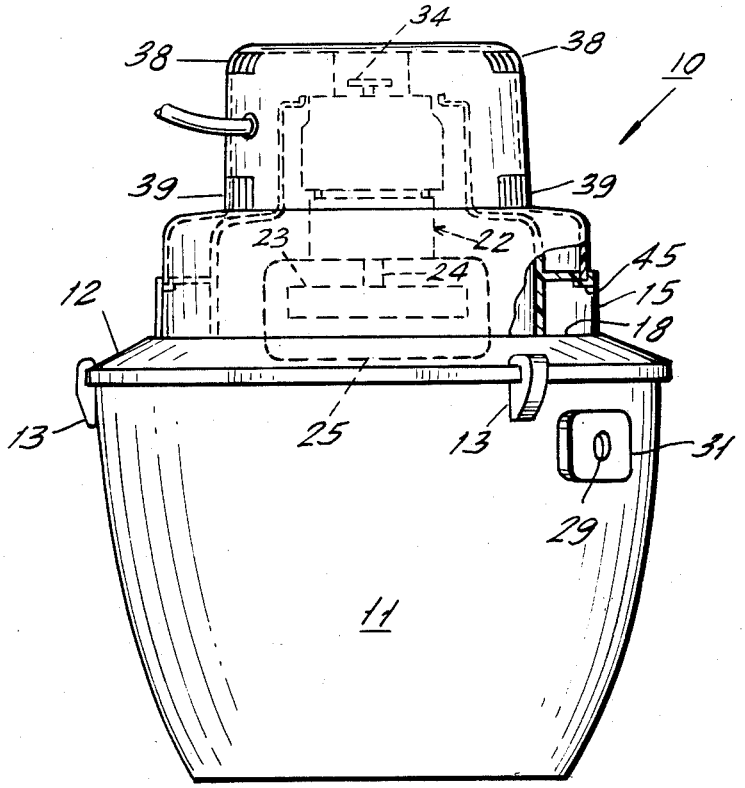
FIG. 1 is a side elevation of a bypass type vacuum cleaner constructed in accordance with teachings of the instant invention.
Figure 2:
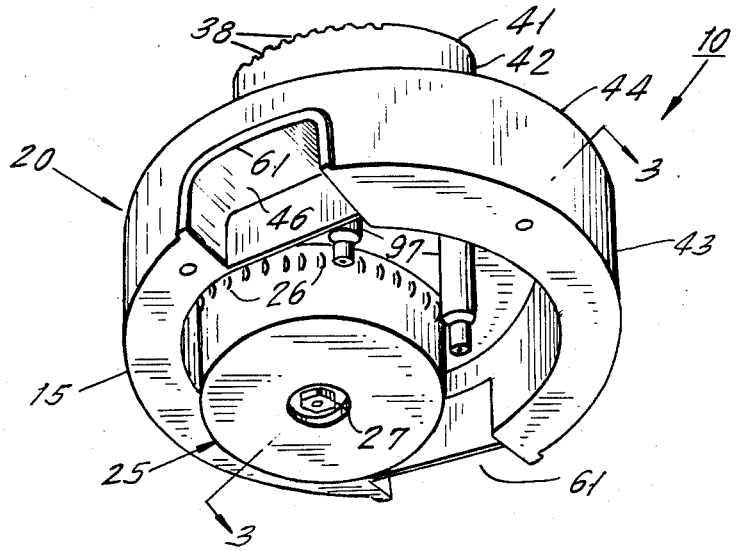
FIG. 2 is a perspective looking toward the bottom of a motor/fan unit disposed within a housing assembly constructed in accordance with the teachings of the instant invention.
Figure 9:
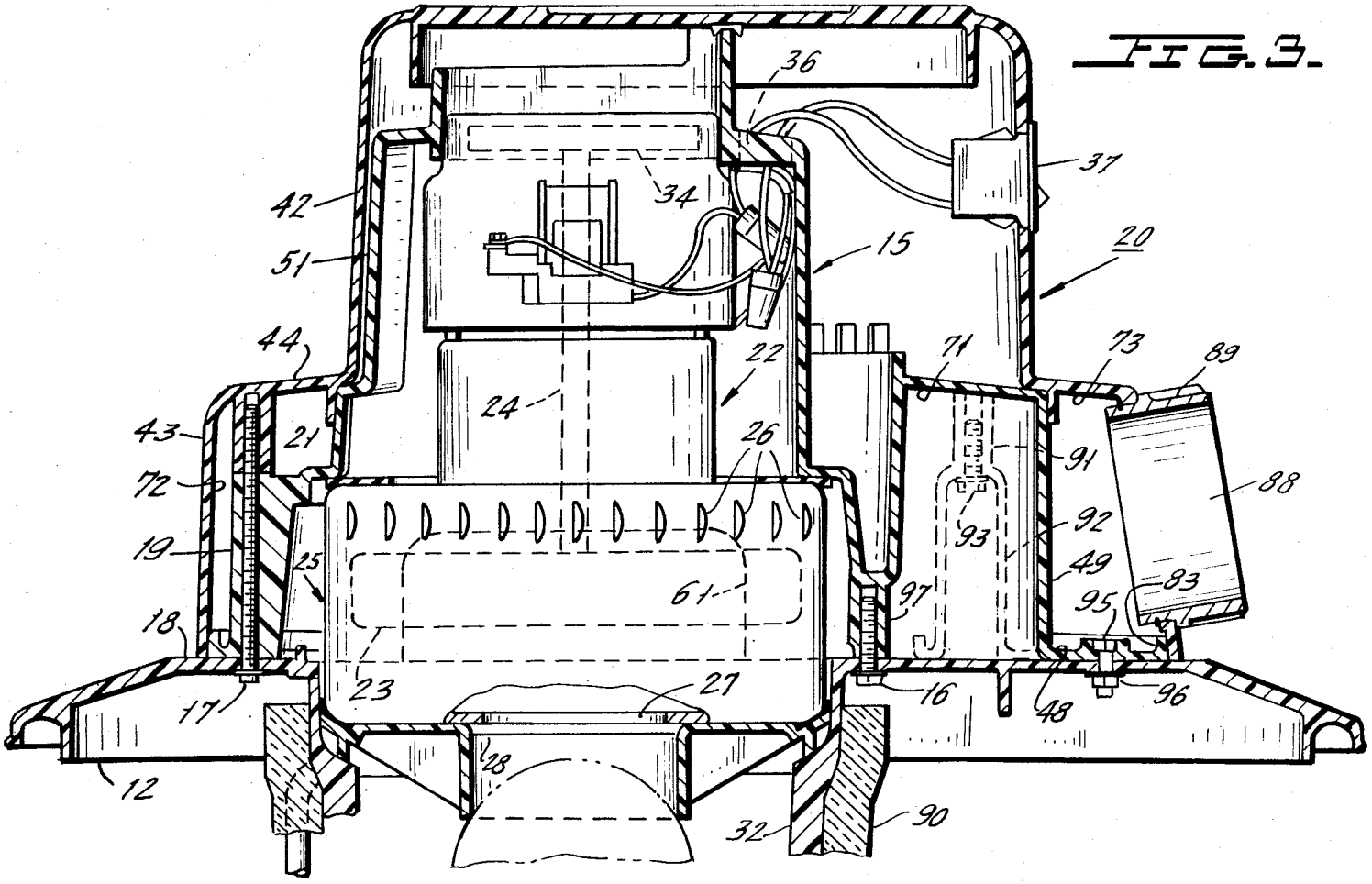
Figure 4:
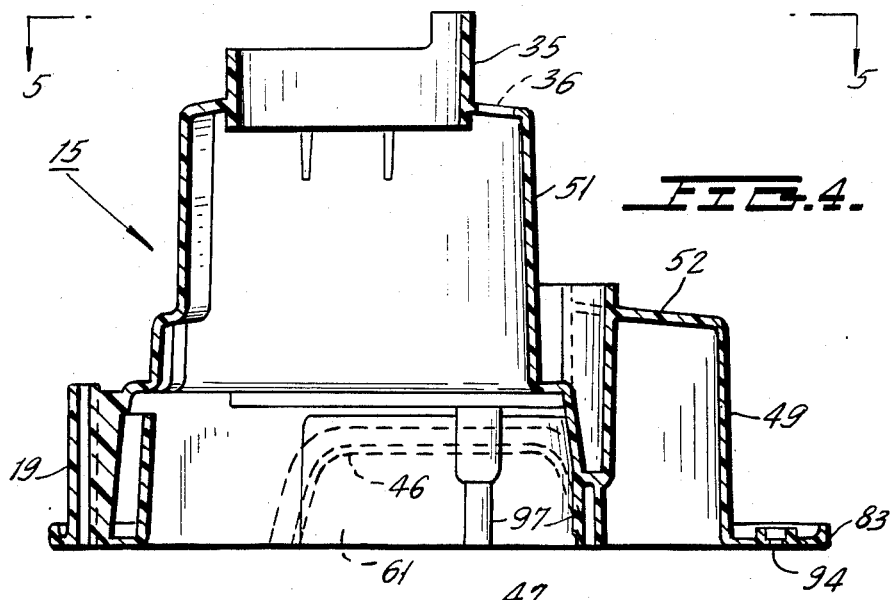
FIG. 4 is a cross-section taken through line 4—4 of FIG. 5 looking in the direction of arrows 4—4.
Figure 5:
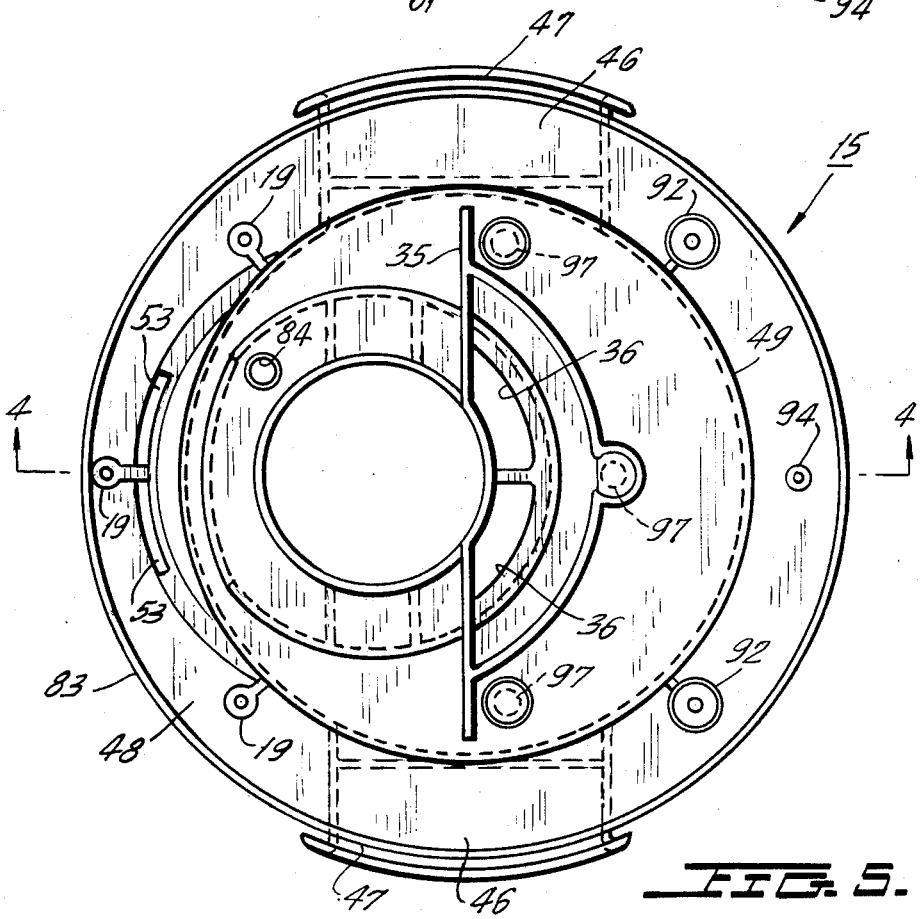
FIG. 5 is a plan view of the motor housing looking in the direction of arrows 5—5 of FIG. 4.

Now referring to the figures. Vacuum cleaner 10 includes tank 11 that is free-standing on its lower end. Buckle type clamps 13 removably secure disk-like lid 12 over the open top of tank 11. Screws 16 (FIG. 3) retain molded plastic insulating motor housing 15 (FIG. 4) in operative position on upper surface 18 of lid 12 by extending through clearance apertures in the latter and being threadably received within central bores in three posts 97 formed integrally with housing 15. Three screws 17 extend though clearance apertures in lid 12, extend through bores in posts 19 of housing 15 and are threadably received in apertures of posts 21 formed integrally with molded plastic cover 20 wherein motor housing 15 is disposed. Additional securement of housing 15 to lid 12 is obtained by nut 95 and screw 96, the latter extending through housing aperture 94. Two screws 93 extend through clearance apertures at the tops of hollow posts 92 formed integrally with motor housing 15 and are threadably received by posts 91 of cover 20.

Disposed within housing 15 and positioned above lid 12 is an assembly that includes electric motor 22, pancake type fan impeller 23 keyed to output shaft 24 of motor 22, and fan housing 25 which operatively supports motor 22 and surrounds impeller 23. The round sidewall of housing 25 is provided with a plurality of louvered slit-like apertures 26 through which air is driven from housing 25 by impeller 23. Aperture 27 in the center of the bottom wall of housing 25 constitutes an inlet for air drawn into housing 25 by fan impeller 23. Aperture 28 in lid 12 is aligned with aperture 27 so that rotation of impeller 23 by motor 22 draws a stream of working air into tank 11 at the side thereof through aperture 29 in hose fitting 31, through dust filter 90 on the outside of circular cage 32 extending downward from lid 12, through lid aperture 28 and aperture 27 aligned therewith, to the central region of impeller 23. The working air is directed outward (sideways) by impeller 23 through housing apertures 26, redirected by louvres associated with apertures 26 to flow generally tangentially and finally through a series of chambers and passages in casing 15 and 20 (to be hereinafter described) and then expelled through outlet aperture 88 in fitting 89 secured to cover 20. Fitting 89 is provided for attachment of a tube when it is desired to utilize vacuum cleaner 10 as a blower.

Figure 6:
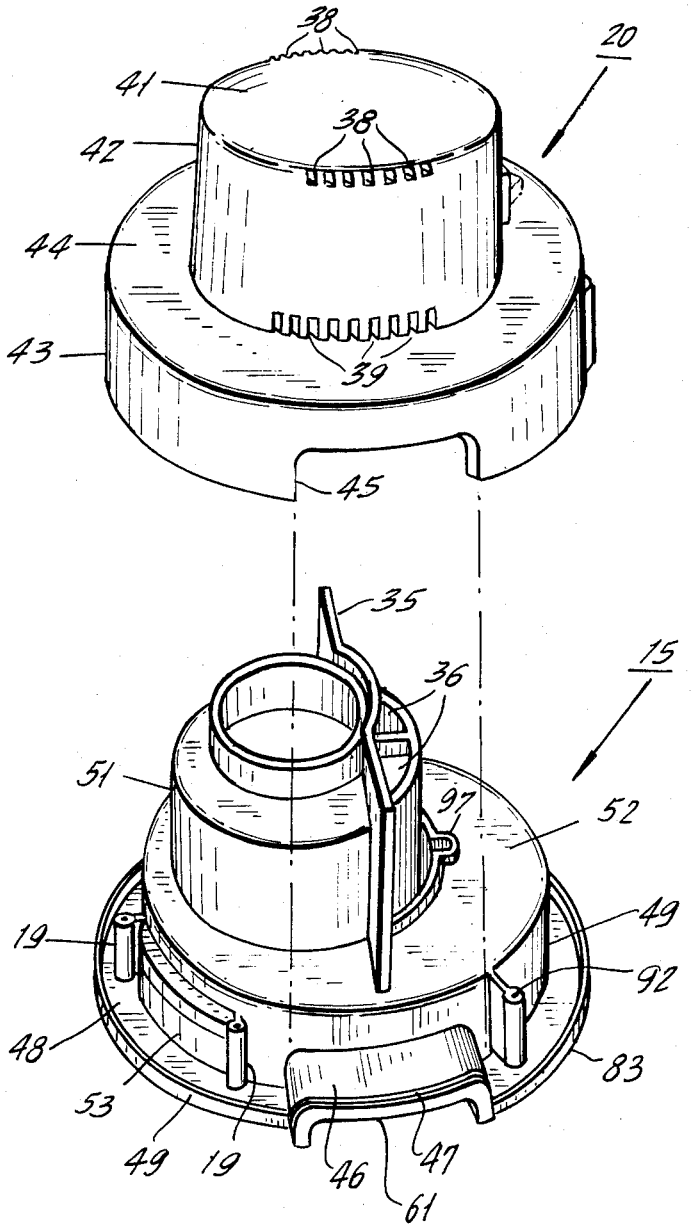
FIG. 6 is an exploded perspective of the motor housing and its cover.

Fan blade 34 keyed to motor shaft 24 at the top thereof creates a stream of air that moves downward through motor 22 for cooling thereof. Barrier 35 at the top of housing 15 extends upward to the inner surface at the top of cover 20 for isolating exhausted cooling air from the motor cooling air being drawn in by blade 34. Motor cooling air is exhausted from motor housing 15 through apertures 36 thereof. Wires for electrically connecting control switch 37 to motor 22 also pass through apertures 36 and another aperture 84. The motor cooling air is exhausted from cover 20 through some of the apertures in the groups of upper and lower slots 38, 39. The remaining slots 38, 39 are provided for intake of cooling air. The function of particular slots in grooves 38, 39 depends upon the location of the slots relative to barrier 35. That is, slots 38, 39 to the left of barrier 35 in FIG. 6 function as cooling air intakes and the remaining slots 38, 39 are cooling air exhausts.

Now referring more particularly to FIGS. 3–7. Cover 20 is a hollow member that includes upper horizontal wall 41 and circular sidewall 42. Cover 20 also includes a lower section defined by circular sidewall 43 that is connected to wall 42 by horizontal ledge 44. Wall 43 is substantially greater in diameter and is substantially shorter than wall 42. Diametrically opposed, generally rectangular notches 45 extend upwardly from the lower edge of wall 43 to provide clearances for hand grips 46 form integrally with motor housing 15. The margins of wall 43 surrounding notches 45 are received within slots 47 in the exterior of motor housing 15. The latter also includes ring-like bottom wall 48 whose outer edge is provided with short upwardly projecting lip 83 that is disposed against the inner surface of cover wall 43. The inner edge of ring 48 is provided with circular wall 49 that is slightly shorter than side-wall 43.

Motor housing 15 also includes upper section 51 having a lower portion that is partially overlapped by the upper end of sidewall 49. Horizontal ledge 52 extends inward from the upper edge of sidewall 49 and for the most part extends to upper section 51. Motor 22 is positioned by upper section 51 so that fan housing 25 is eccentric with respect to sidewall 49. At the region where fan housing 25 is closest to sidewall 49, the latter is provided with apertures 53, for reasons to be hereinafter explained.

Each of the hand grips 46 is a generally inverted U-shaped formation with an elongated web that extends across the entire bottom wall 48 of motor housing 15 so as to provide a recess 61 for insertion of fingers when it is desired to lift lid 12 and elements carried thereby from tank 11.

Figure 7:
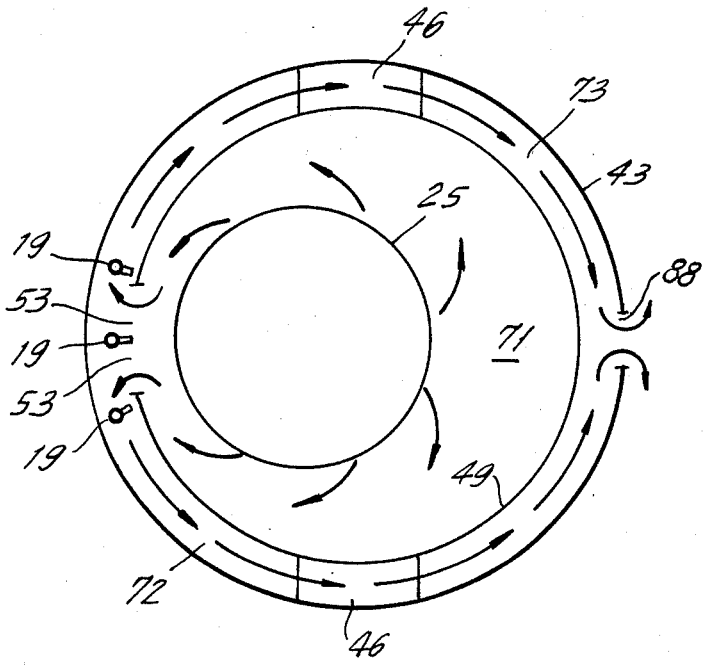
FIG. 7 is a schematic illustrating the flow of working air.

The flow of working air is best seen with reference to the diagram of FIG. 7 which shows that air exiting from vertical slits 26 in the sidewall of fan housing 25 flows into main chamber 71 formed between the circular sidewall of housing 25 and circular wall 49 of motor housing 15. Working air leaves main chamber 71 and enters the first section 72 of a ring-like auxiliary chamber that surrounds chamber 71 and is defined by inner and outer circular walls 49, 43. Upon entering first section 72, the working air splits (being aided by the middle post 19) and flows in opposite directions, entering second section 73 of the auxiliary chamber through constrictions created by hand grip formations 46, 46. While the latter extend across the full width of auxiliary chamber 72, 73, formations 46 are shorter than the full height of walls 43 and 49, although being a substantial part thereof. Working air entering second portion 73 of the auxiliary chamber 72, 73 through opposite ends of second portion 73 moves toward the center thereof and exits through outlet 88.

Although the present invention has been described in connection with a preferred embodiment thereof, many variations and modifications will now become apparent to those skilled in the art. It is preferred, therefore, that the present invention be limited not by the specific disclosure herein, but only by the appended claims.

What is claimed is:

1. A removable lid assembly for a bypass type vacuum cleaner;

said assembly including an electric motor having a vertical output shaft, a suction producing fan impeller secured to the lower portion of said shaft, a fan housing wherein said impeller rotates, said impeller when rotating drawing suction producing working air upward through an opening in a lower wall of said fan housing and directing said working air radially outward through a sidewall of said fan housing, a casing wherein said motor and fan housing are disposed;

a main chamber defined by a first partition of said casing;

an auxiliary chamber surrounding said first partition and having as its outer boundary a second partition of said casing;

said fan housing being disposed off-center within said main chamber;

means defining diametrically opposed constrictions in said auxiliary chamber that divide the latter into first and second sections;

an exit in said first partition and an outlet in said second petition diametrically opposite side exit;

said working air upon flowing through said exit into said first section dividing and flowing past said constrictions into said second section and toward said outlet from opposite directions;

said means defining the constrictions also defining recesses, each having an open side through which fingers are insertable into said recesses from outside of said casing for gripping said assembly by hand to lift said assembly from a dirt collecting tank on which said assembly is mounted.

2. A lid assembly as set forth in claim 1 in which the working air flows above said finger recesses.

3. A lid assembly as set forth in claim 1 in which the auxiliary chamber is ring-like.

4. A lid assembly as set forth in claim 1 in which the exit is at a portion of said partition located relatively close to said fan housing.

5. A lid assembly as set forth in claim 1 in which the outlet is approximately midway between the contrictions.

6. A lid assembly as set forth in claim 1 in which the exit is approximately midway between the constrictions.

7. A lid assembly as set forth in claim 6 in which the exit is at a portion of said first partition located relatively close to said fan housing.

8. A lid assembly as set forth in claim 7 in which the outlet is approximately midway between the contrictions.

9. A lid assembly as set forth in claim 1 in which the casing includes a cover and a motor housing disposed within the cover, said first partition being integral with said motor housing and said second partition being integral with said cover.

10. A lid assembly as set forth in claim 9 in which the first and second partitions are generally circular.

11. A lid assembly as set forth in claim 10 in which the constrictions extend between the first and second partitions.

12. A lid assembly as set forth in claim 11 in which the first and second partitions are taller than the constrictions.

13. A lid assembly as set forth in claim 12 in which the exit is approximately midway between the constrictions.

14. A lid assembly as set forth in claim 13 in which the exit is at a portion of said first partition located relatively close to said fan housing.

15. A lid assembly as set forth in claim 14 in which the outlet is approximately midway between the contrictions.

16. A lid assembly as set forth in claim 15 in which the working air flows above said finger recesses.

17. A lid assembly as set forth in claim 16 in which the auxiliary chamber is ring-like.

18. A lid assembly as set forth in claim 1 also including means at said exit for attachment of a hose to direct working air exiting through said exit and utilize same for blowing purposes.

* * * * *